US006379216B1

(12) United States Patent
Raeder

(10) Patent No.: US 6,379,216 B1
(45) Date of Patent: Apr. 30, 2002

(54) ROTARY CHEMICAL-MECHANICAL POLISHING APPARATUS EMPLOYING MULTIPLE FLUID-BEARING PLATENS FOR SEMICONDUCTOR FABRICATION

(75) Inventor: Christopher H. Raeder, Austin, TX (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/427,463

(22) Filed: Oct. 22, 1999

(51) Int. Cl.[7] ..... B24B 49/00

(52) U.S. Cl. ..... 451/5; 451/283; 451/287; 451/288

(58) Field of Search ..... 451/5, 41, 283, 451/285, 287, 288, 303, 307

(56) References Cited

U.S. PATENT DOCUMENTS 5,230,184 A * 7/1993 Bukhman ..... 451/283
5,558,568 A * 9/1996 Talieh et al. ..... 451/303
5,593,344 A * 1/1997 Weldon et al. ..... 451/303
5,664,989 A * 9/1997 Nakata et al. ..... 451/41
5,722,877 A * 3/1998 Meyer et al. ..... 451/41
5,762,536 A * 6/1998 Pane et al. ..... 451/6
5,800,248 A * 9/1998 Pant et al. ..... 451/41
5,816,900 A * 10/1998 Nagahara et al. ..... 451/285
5,871,390 A * 2/1999 Pant et al. ..... 451/5
5,916,012 A * 6/1999 Pant et al. ..... 451/41
5,931,719 A * 8/1999 Nagahara et al. ..... 451/41
6,086,456 A * 7/2000 Weldon et al. ..... 451/41
6,108,091 A * 8/2000 Pecen et al. ..... 451/6
6,129,610 A * 10/2000 Stephens ..... 451/41
6,165,057 A * 12/2000 Gill, Jr. ..... 451/287
6,217,419 B1 * 4/2001 Maury et al. ..... 451/41

* cited by examiner

*Primary Examiner*—M. Rachuba
(74) *Attorney, Agent, or Firm*—Kevin L. Daffer; Conley, Rose & Tayon P.C.

(57) ABSTRACT

A rotary chemical-mechanical polishing apparatus with multiple fluid-bearing platens for use in semiconductor fabrication is described together with a method for chemical-mechanical polishing of semiconductor substrates ("wafers"). A single polishing pad is affixed to a pad backing composed of a thin metal membrane. A polishing fluid is introduced onto an upper surface of the polishing pad. One or more wafers are held face down upon the upper surface of the polishing pad by carriers. Fluid-bearing platens are placed below a lower surface of the pad backing and located directly underneath each wafer. While polishing wafers, the polishing pad and pad backing are rotated about their common center, each carrier and wafer pair is rotated about its common center, the carriers apply a down force on the wafers, and the fluid-bearing platens support the pad backing. The fluid-bearing platens support the pad backing with a fluid flow that exerts a pressure on the pad backing. Within a single fluid-bearing platen, multiple zones of different fluid flow rates allow control of the polishing uniformity. Further, the fluid flow rate distribution of each fluid-bearing platen can be individually controlled.

21 Claims, 4 Drawing Sheets

ROTARY CHEMICAL-MECHANICAL POLISHING APPARATUS EMPLOYING MULTIPLE FLUID-BEARING PLATENS FOR SEMICONDUCTOR FABRICATION

BACKGROUND OF THE INVENTION

1. Field of the Invention

This invention relates to semiconductor processing and, more particularly, a chemical-mechanical polishing apparatus and method for planarizing the upper surfaces of semiconductor substrates.

2. Description of the Relevant Art

Fabrication of integrated circuits upon semiconductor substrates ("wafers") involves numerous processing steps. For example, the fabrication of a metal-oxide-semiconductor (MOS) integrated circuit includes the formation of trench isolation structures within a semiconductor substrate to separate each MOS field-effect transistor that will be made. The semiconductor substrate is typically doped with either n-type or p-type impurities. A gate dielectric, typically composed of silicon dioxide, is formed on the semiconductor substrate. For each MOSFET being made, a gate conductor is formed over the gate dielectric and a source and drain are formed by introducing dopant impurities into the semiconductor substrate. Conductive interconnect lines are then formed to connect the MOSFETs to each other and to the terminals of the completed integrated circuit. Modern high-density integrated circuits typically include multiple interconnect levels to provide all of the necessary connections. Multiple interconnect levels are stacked on top of each other with intervening dielectric levels providing electrical insulation between interconnect levels.

During integrated circuit fabrication, unwanted elevational disparities of the upper surface of the semiconductor substrate that can occur after certain processing steps may have a detrimental effect on subsequent processing steps. For example, prior to formation of interconnect levels of an integrated circuit, a dielectric is deposited upon the transistors that have been formed on the semiconductor substrate. As deposited, this dielectric typically will not have a planar upper surface but will instead tend to conform to the underlying topography. If these elevational disparities are not removed, subsequent processing steps may suffer from a variety of problems. For instance, an interconnect metal deposited upon the non-planar upper surface of the dielectric may exhibit step coverage problems. Step coverage is an indication of how well a film conforms to an underlying step. If the interconnect metal is not deposited with sufficient step coverage, interconnect lines patterned from the interconnect metal may suffer from open circuit failure. A non-planar surface may also cause depth-of-focus problems for subsequent lithographically-patterned layers. Depth-of-focus refers to the ability of a lithographic systems to focus radiation on a photoresist only over a limited thickness. If a portion of the photoresist is at a different elevation than the rest of the photoresist due to a non-planar underlying surface, the elevationally disparate portion of the photoresist may not be fully exposed by the lithographic system resulting in a patterning of the photoresist different from the desired pattern.

Chemical-mechanical polishing (CMP) is a prevalent technique for planarizing surfaces of semiconductor substrates and thereby avoiding the problems discussed above. CMP removes surface material and planarizes surfaces through chemical and mechanical abrasion of surface material. FIG. 1 illustrates a cross-sectional side view of a portion of a rotary CMP apparatus ("tool") while FIG. 2 illustrates a top view of the CMP tool. An example of a rotary CMP tool is the Auriga available from SpeedFam International, Inc. of Chandler, Ariz. Semiconductor wafer 10 is held in carrier 12 and is placed face down upon polishing pad stack 20. Although four carrier/wafer assemblies 14 are shown in FIG. 2, polishing pad stack 20 may have one to six carrier/wafer assemblies placed upon it depending on the size of wafer 10 relative to the size of polishing pad stack 20. Polishing pad stack 20 is affixed to platen 22. Both carrier 12 and platen 22 may rotate and their rotational speeds are independently adjustable. A polishing fluid, typically a slurry, is deposited on the surface of polishing pad stack 20 through conduit 24. The polishing slurry consists of an abrasive-particle-containing fluid that may be chemically reactive with one or more of the materials on the surface of the wafer. The polishing slurry occupies the interface between wafer 10 and polishing pad stack 20.

During the polishing process, carrier 12 and platen 22 are rotated at angular frequencies $\omega_c$ and $\omega_p$, respectively, while carrier 12 applies a force F downward on wafer 10, typically referred to as "down force". The polishing slurry chemically reacts with the surface material of wafer 10 while the movement of wafer 10 relative to polishing pad stack 20 causes the abrasive particles contained in the polishing slurry to strip the reacted material from wafer 10. The amount of material removed by CMP is governed by several variables including down force, carrier rotational speed, platen rotational speed, polishing time, and composition of the polishing fluid.

Polishing pad stack 20 includes polishing pad 16 and polishing pad 18 affixed to platen 22. Polishing pad 16 is preferably harder than polishing pad 18. Platen 22 provides rigid support for polishing pad stack 20. A typical pad stack used on CMP tools is an IC1000 stacked on top of a Suba IV. Both pads are manufactured by Rodel, Inc. of Phoenix, Ariz. Multiple pads are typically used to simultaneously improve both local flatness and global uniformity of the polished wafer. A problem with polishing pad stack 20 is that replacement of worn out pads is time consuming. Replacing pads requires that pads 16 and 18 be removed from platen 22 and then new pads must be affixed to platen 22. During the replacement process, the CMP tool is not available for use thereby increasing manufacturing costs.

FIG. 3 shows a portion of a wafer, which includes semiconductor substrate 30, in contact with polishing pad stack 20. Layer 32, which has surface irregularities that are to be removed, has been previously formed upon semiconductor substrate 30. Elevationally raised area 34 is in contact with hard polishing pad 16 which is attached to soft polishing pad 18. Polish pad 16 has deformed slightly and projects in toward elevationally depressed area 36. The harder polish pad 16 is, the less it will deform. The ideal CMP process would only remove material from elevationally raised area 34 and not from elevationally depressed area 36 and would result in surface 38 of layer 32 after polishing. Realistically, some material is removed from elevationally depressed area 36; however, material is removed at a higher rate from elevationally raised area 34 such that surface 40 results after polishing. Layer 32 has an average thickness t after polishing. In general, the flatness and location of actual polished surface 40 is desired to be as similar as possible to ideal polished surface 38.

It is also desired for surface 40 of the polished wafer to have good uniformity, which can be defined as average thickness t of layer 32 being the same at all locations on semiconductor substrate 30. Softer polishing pad 18 is placed underneath harder polishing pad 16 to improve uniformity of the polished wafer. Softer polishing pad 18 allows polishing pad stack 20 to partially conform to minor changes in the overall shape of the wafer. For instance, if semiconductor substrate 30 is slightly bowed, the polishing pad stack will also be slightly bowed so it can remain in contact with the wafer over its entire surface while the use of hard polishing pad 16 as the top polishing pad minimizes conformance of the polishing pad stack to local surface irregularities that are to be removed. In general, the CMP process parameters include a low down force, a high rotational speed, and a hard polishing pad to improve uniformity. Better uniformity generally results in increased yield, which is defined as the percentage of completed integrated circuits that are functional. Increased yield represents a reduction in the cost of manufacturing integrated circuits.

Linear CMP tools have been developed to improve the uniformity of polished wafers. FIG. 4 depicts a cross-sectional side view of a portion of a linear CMP tool. An example of a linear CMP tool is the Teres™ manufactured by Lam Research Corporation of Fremont, Calif. Semiconductor wafer 50 is held in carrier 52 and placed face down upon belt 54. At most, two semiconductor wafers can be polished simultaneously by linear CMP tools. Belt 54 includes multiple polishing pads affixed to a thin metal backing. Typically, three polishing pads are required to cover the metal backing. Belt 54 is held in place and tensioned by rollers 56 and rotation of rollers 56 causes belt 54 to move. During the polishing process, a polishing fluid is applied to an upper surface of belt 54 through conduit 60. Carrier 52 rotates at an angular frequency $\omega_c$ while belt 54 passes underneath wafer 50 at speed $v_b$. Carrier 52 also applies a down force F on wafer 50. To prevent belt 54 from deflecting downward from this force, platen 58 is placed below belt 54 and located directly underneath wafer 50.

Platen 58 may be a solid fixture that provides rigid support of belt 54; however, for improved uniformity of the polished wafer, platen 58 may be a fluid-bearing platen. The fluid-bearing platen does not make contact with belt 54, but instead supports belt 54 to with a fluid flow. The pressure exerted by the fluid flow provides a counter force to down force F exerted by carrier 52. The flow rate at different locations on the fluid-bearing platen may be adjusted so that the wafer is polished at different rates at different locations so that improved uniformity results.

Problems may occur with the linear CMP due to its increased complexity. During polishing, belt 54 must be kept properly tensioned or the wafer being polished may be damaged or destroyed. Additionally, belt 54 has a tendency to wander off rollers 56 which may also damage or destroy the wafer being polished. The polishing pads are also subject to more stress since they must conform to the shape of rollers 56 as they pass over the rollers. Replacement of worn out pads is time consuming. After the old belt is removed, the new belt must be installed and properly tensioned and aligned so that it will function properly. During belt installation, the linear CMP tool is not available for use thereby increasing manufacturing costs.

Although a linear CMP tool with a fluid-bearing platen is often recognized as leaving polished wafers with better uniformity than most rotary CMP tools, the rotary CMP has higher throughput since it can polish multiple wafers simultaneously. Better uniformity of the polished wafers results in increased yield and reduced manufacturing costs; however, higher throughput increases productivity which also reduces manufacturing costs. Additionally, both types of CMP tools require multiple polishing pads. A rotary CMP tool typically uses two polishing pads stacked on top of each other while a linear CMP tool typically requires three polishing pads to cover the entire belt.

It therefore is desirable to develop an improved CMP tool that incorporates both good throughput and good uniformity while keeping the construction of the tool as simple as possible. It is also desirable to develop an improved CMP tool that requires only a single polishing pad that could be quickly replaced after it has worn out.

SUMMARY OF THE INVENTION

The problems described above are addressed in large part by a rotary CMP tool that employs multiple fluid-bearing platens. A single round polishing pad is affixed to a round pad backing that is a taut, thin metal membrane preferably composed of stainless steel. The polishing pad is preferably an industry-standard hard polishing pad. A holder is attached to the edges of the pad backing and facilitates rotation of the polishing pad and pad backing about their common center. A conduit allows a polishing fluid to be introduced onto an upper surface of the polishing pad. One or more wafers are held face down upon the upper surface of the polishing pad by carriers. The carriers apply a down force on the wafers. Each carrier and wafer pair rotates about its common center. Fluid-bearing platens are placed below a lower surface of the pad backing and located directly underneath each wafer. The fluid-bearing platens do not make mechanical contact with the pad backing. The fluid-bearing platens support the pad backing with a fluid flow. The pressure exerted by the fluid flow provides a counter force to the down force exerted by the carrier. Multiple zones of differing fluid flow rates within the fluid-bearing platen allow control of the polishing uniformity of the wafer. Additionally, the fluid flow rate distribution of each fluid-bearing platen can be individually adjusted. The fluid can be a liquid or gas and is preferably air.

The fluid-bearing platen can generate multiple zones of differing fluid flow rate by having a plurality of conduits within the platen. The flow rate of fluid through one conduit may be adjusted relative to the other conduits to produce differing flow rates. Preferably, the flow rate through each conduit can be individually adjusted to maximize the uniformity of the polished wafers. For example, if polished wafers are observed to have more material removed at the edges than at the center, the flow rate of conduits under the center of the wafer may be increased relative to the flow rate of conduits under the edge of the wafer and thereby improve the uniformity. Additionally, the distribution of flow rates for each fluid-bearing platen is adjustable independent of the other fluid-bearing platens so that the wafers polished over each platen exhibit good uniformity.

A rotary CMP tool with multiple fluid-bearing platens allows both good uniformity and high throughput. The ability to polish multiple wafers simultaneously provides a throughput equivalent to that of a standard rotary CMP tool. The use of fluid-bearing platens provides a uniformity of polished wafers equivalent to that of a linear CMP tool and therefore an improved yield of the completed integrated circuits over that of the standard CMP tool. Since the use of the rotary CMP tool with multiple fluid-bearing platens simultaneously allows good throughput and good yield, its use results in a significant reduction in manufacturing costs of integrated circuits.

The use of a single polishing pad also represents a simplification and a cost savings over the stack of two polishing pad typical of standard rotary CMP tools or the three pieces of polishing pad typically used by linear CMP tools. Pad replacement on the rotary CMP tool with multiple fluid-bearing platens is also simplified. Pad replacement can be accomplished by simply replacing the old pad and pad backing with a new pad and pad backing. The old pad may be removed and a new pad affixed to the old pad backing elsewhere. This results in an increase tool usage and therefore a decrease of manufacturing costs over the typical practice for a standard CMP tool of removing the old pad stack and affixing a new pad stack with the solid platen in situ.

BRIEF DESCRIPTION OF THE DRAWINGS

Other objects and advantages of the invention will become apparent upon reading the following detailed description and upon reference to the accompanying drawings in which.

Figure 1:
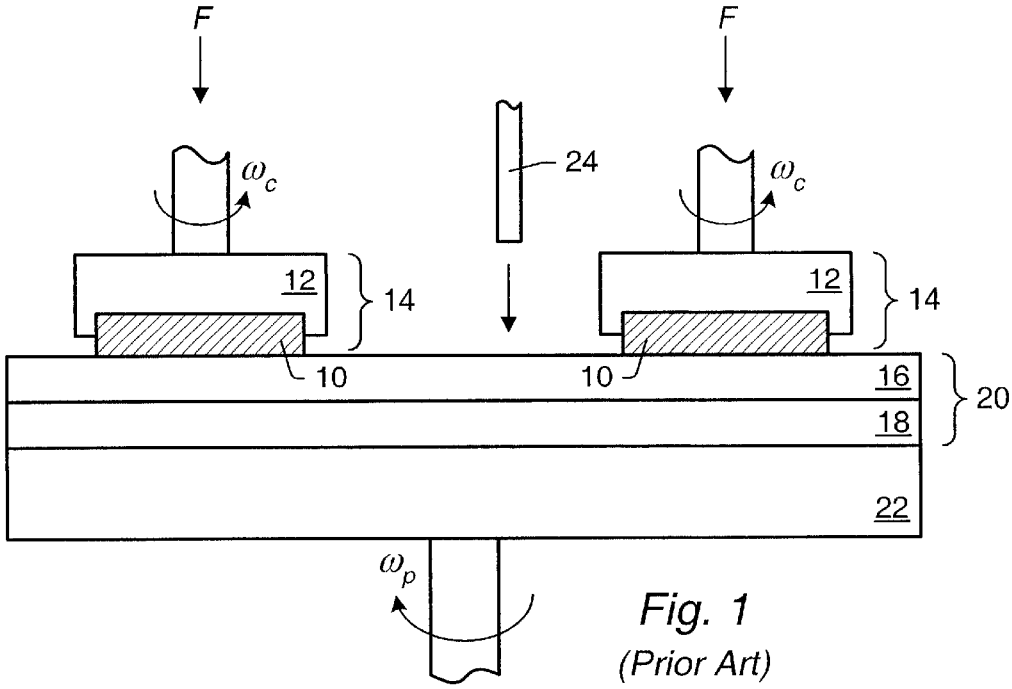
Fig. 1 (Prior Art)
FIG. 1 is a cross-sectional side-view schematic of a rotary CMP tool.
Figure 2:
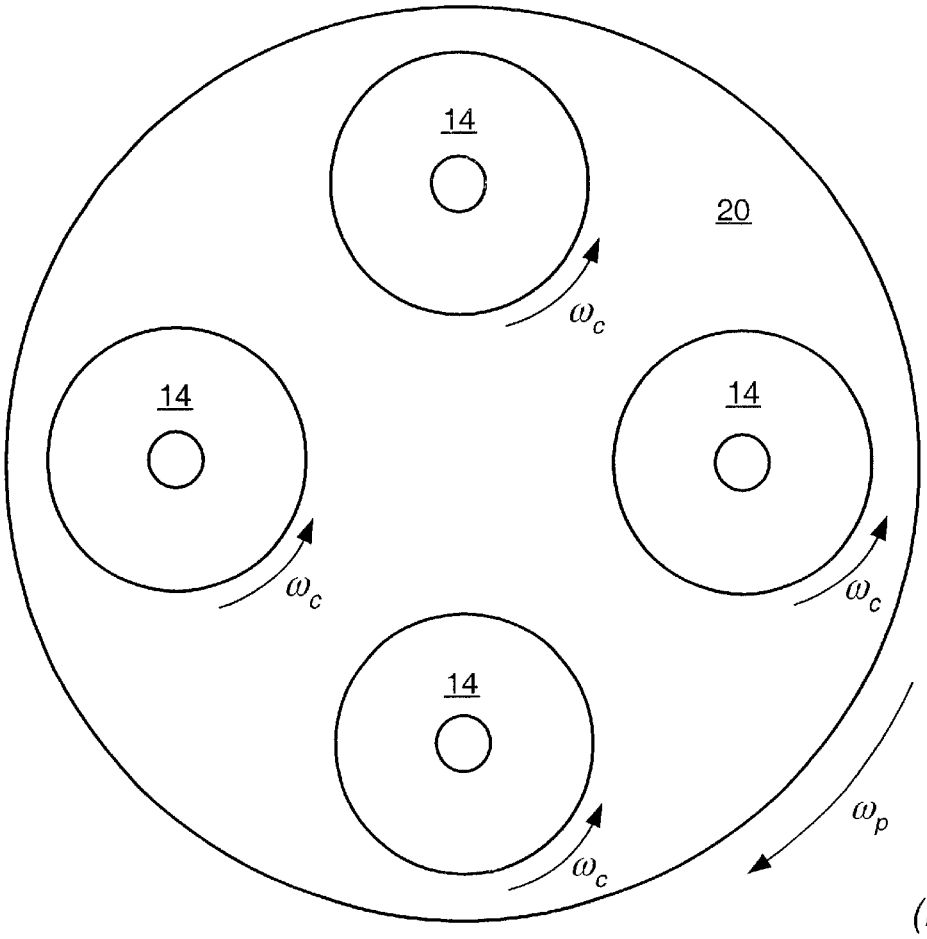
Fig. 2 (Prior Art)
FIG. 2 is a top-view schematic of the rotary CMP tool shown in FIG. 1.
Figure 3:
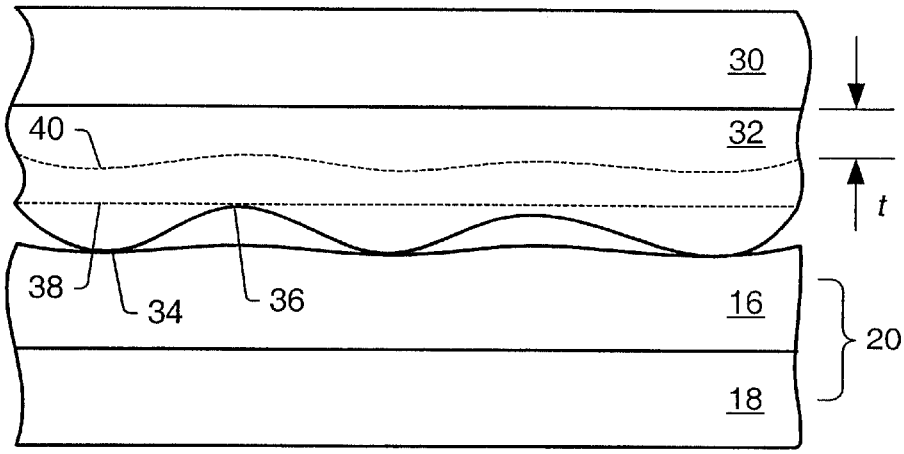
Fig. 3 (Prior Art)
FIG. 3 is a is a partial cross-sectional view of a semiconductor topography, which includes a semiconductor substrate, a layer formed on the semiconductor substrate that contains surface irregularities that are to be removed, and a polishing pad stack.
Figure 4:
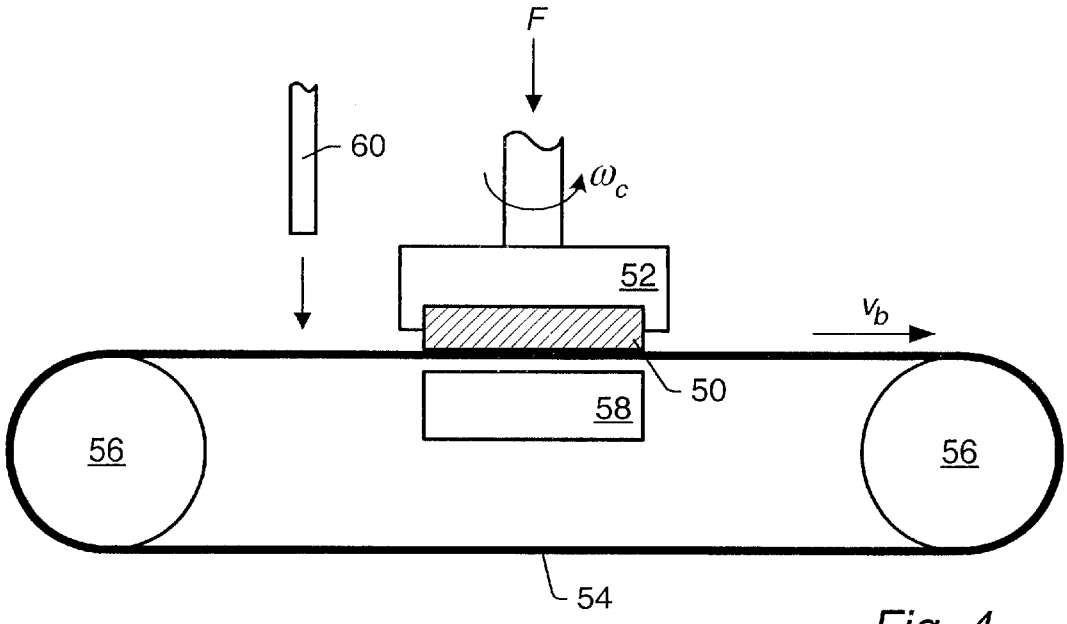
Fig. 4 (Prior Art)
FIG. 4 is a cross-sectional side-view schematic of a linear CMP tool.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed. On the contrary, the intention is to cover all modifications, equivalents, and alternatives falling within the spirit and scope of the present invention.

DETAILED DESCRIPTION OF THE PREFERRED EMBODIMENTS

Figure 5:
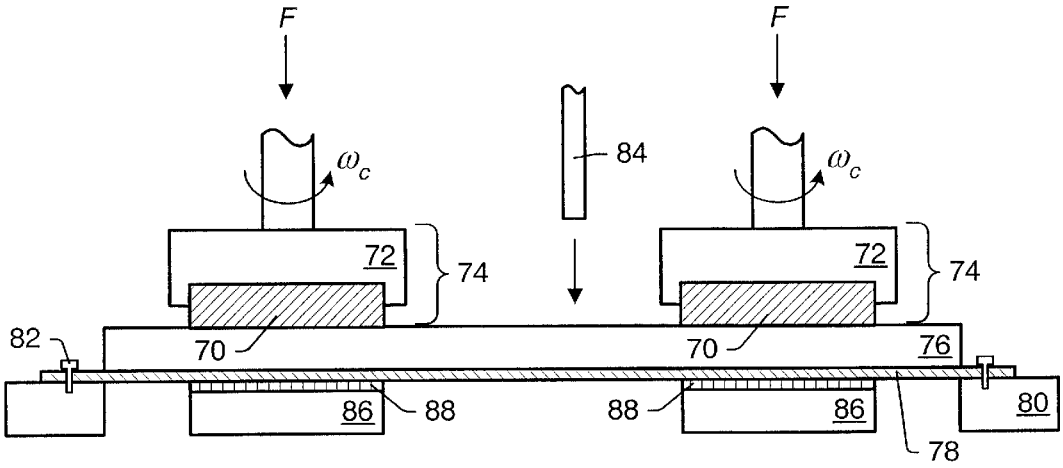
FIG. 5 is an exemplary cross-sectional side-view schematic of a rotary CMP tool that employs a fluid-bearing platen.
Figure 6:
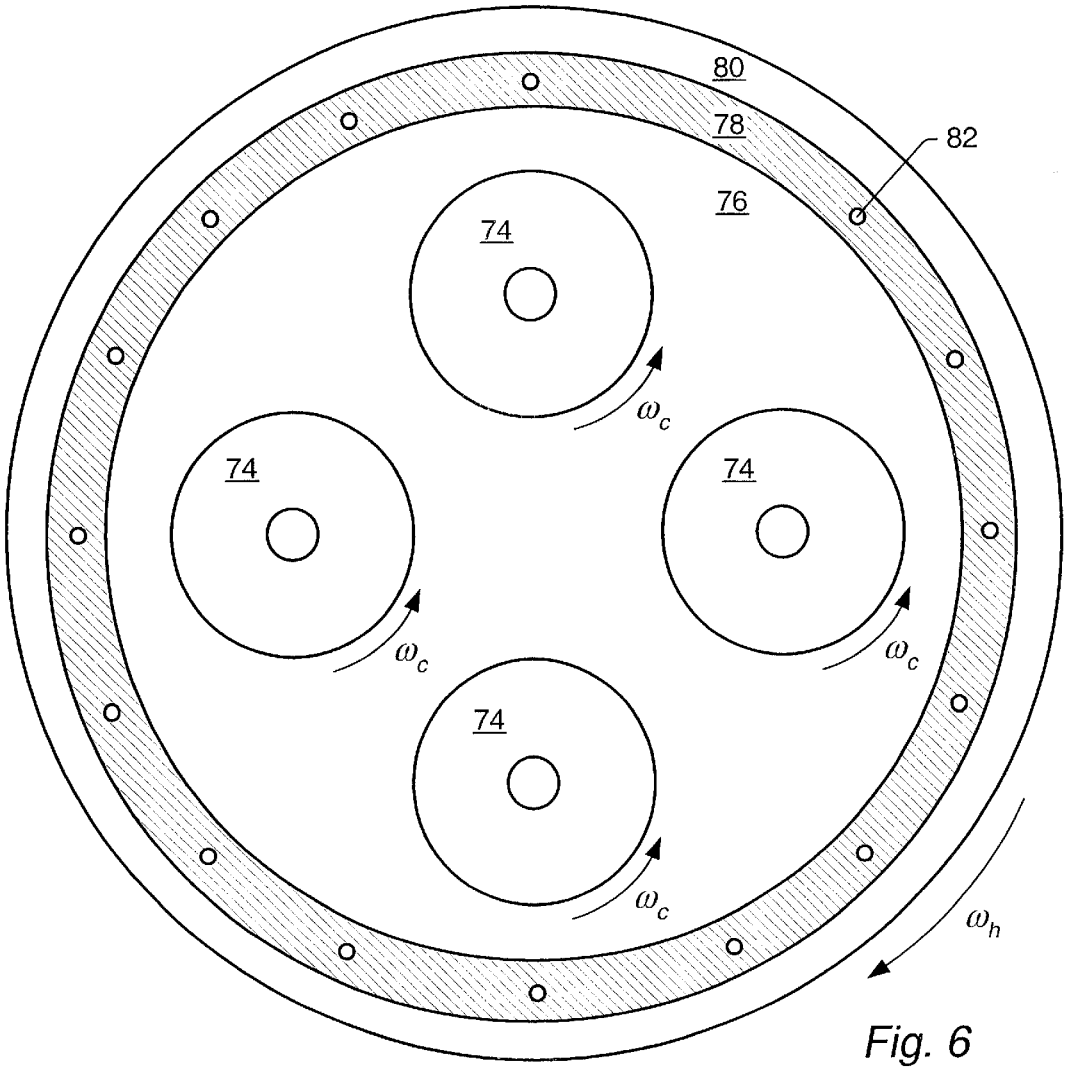
FIG. 6 is an exemplary top-view schematic of the rotary CMP tool shown in FIG. 5.

Turing now to the figures, FIG. 5 shows an exemplary cross-sectional side view of a portion of a rotary CMP tool employing multiple fluid-bearing platens while FIG. 6 shows an exemplary top view of the CMP tool. Semiconductor wafer 70 is held face down upon polishing pad 76 by carrier 72. Although four wafer/carrier assemblies 74 are shown in FIG. 6, there could be other quantities of wafer/carrier assemblies 74 placed upon polishing pad 76. As few as one wafer/carrier assembly 74 could be placed upon polishing pad 76; however, to increase the throughput of the CMP tool it is desired to place multiple wafer/carrier assemblies 74 upon polishing pad 76. The maximum number, which may exceed four, of wafer/carrier assemblies 74 that can be placed upon polishing pad 76 will be determined by the size of wafer 70 relative to that of polishing pad 76.

Polishing pad 76 is attached to pad backing 78 by the use of an adhesive or other means. Polishing pad 76 is preferably an industry standard hard polishing pad while pad backing 78 is preferably a taut, thin metal membrane. Pad backing 78 may be composed of stainless steel or other metals. A preferred thickness of pad backing 78 is approximately 0.5 mm. Since polishing pad 76 is hard, conformance of polishing pad 76 to local surface irregularities, which are to be removed, on wafer 70 is minimized resulting in improved flatness of the polished wafer. The thin metal membrane used for pad backing 78 is flexible and its use ensures that polishing pad 76 may stay in contact with wafer 70 over the wafer's entirety such that good uniformity of the polished wafer results.

An outer edge of pad backing 78 is attached to holder 80. Pad backing 78 is depicted as being attached to holder 80 by a plurality of bolts 82 inserted through holes in pad backing 78 and screwed into holder 80; however, pad backing 78 may be attached to holder 80 by other means such as clamps or adhesives. Polishing pad 76, pad backing 78, and holder 80 rotate about their common center. Rotation can be accomplished by applying a force to holder 80 with a belt drive or other means. Once polishing pad 76 is worn out, replacement is easily facilitated by removing bolts 82 and then removing polishing pad 76 and pad backing 78. A new polishing pad and pad backing can then be bolted onto holder 80 and the CMP tool can be placed back into production. The old pad can be removed from the pad backing and a new polishing pad can be attached to the pad backing at a different location.

During the polishing process, each of wafer/carrier assemblies 74 is rotated about their center at an angular frequency $\omega_c$ while polishing pad 76, pad backing 78, and holder 80 are rotated about their common center at angular frequency $\omega_h$. Conduit 84 supplies a polishing fluid onto the upper surface of polishing pad 76. The polishing fluid may be a polishing slurry that includes an abrasive-particle-containing fluid that may be chemically reactive with one or more of the materials on the surface of wafer 70. The polishing fluid occupies the interface between wafer 70 and polishing pad 76. Carrier 72 applies a down force F to wafer 70. A counter force to down force F is supplied by fluid-bearing platen 86 that directs a fluid flow 88 at the lower surface of pad backing 78 directly underneath wafer 70. Fluid-bearing platens 86 are present below each wafer 70. A pressure exerted by fluid flow 88 provides the counter force to down force F. The fluid can be either a liquid or a gas. The fluid is preferably composed of air.

Figure 7:
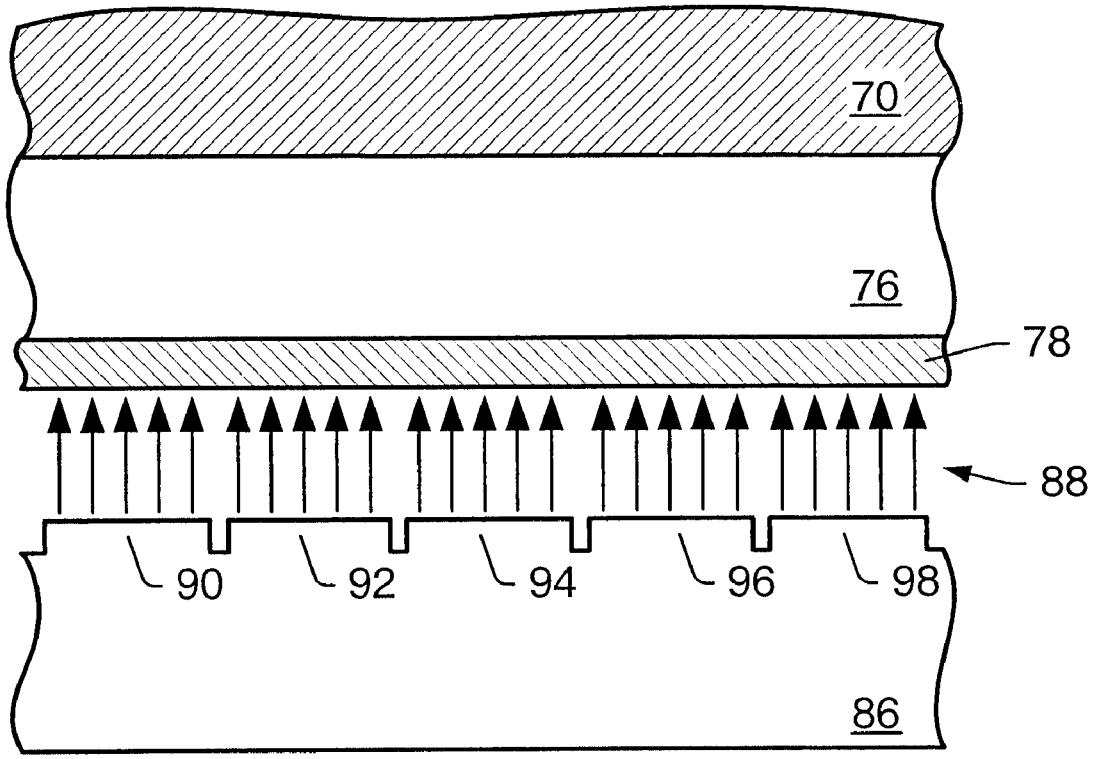
FIG. 7 is an exemplary cross-sectional side-view schematic of the fluid-bearing platen, polishing pad, and semiconductor substrate shown in FIG. 5.

FIG. 7 illustrates an exemplary cross-sectional side view of a portion of FIG. 5 including portions of fluid-bearing platen 86, polishing pad 76, and wafer 70. Fluid flow 88 is directed at the lower surface of pad backing 78 through conduits 90, 92, 94, 96, and 98. Fluid-bearing platen 86 preferably includes a plurality of conduits for directing fluid flow 88 at the lower surface of pad backing 78. Conduits 90, 92, 94, 96, and 98 form a portion of the plurality of conduits. The plurality of conduits may be arranged in a grid pattern or may comprise concentric rings. The flow rate of fluid through each conduit is preferably independently adjustable. This results in multiple zones of different flow rates. If the flow rates through each of the conduits 90, 92, 94, 96, and 98 are different, there would then be five different zones of flow rates, one above each conduit. Additionally, the multiple zones of different flow rates for each of fluid-bearing platens 86 of FIG. 5 are adjustable independent of one another.

By adjusting the flow rate of fluid through various conduits, the uniformity of wafer 70 after polishing may be improved. For example, if polished wafers are observed to have more material removed at the edges than at the center, the flow of fluid through conduits at the center of platen 86 may be increased relative to the flow of fluid through conduits at the edge of platen 86. This results in increased pressure being applied to the lower surface of pad backing 78 underneath the center of wafer 70 relative to the pressure applied to the lower surface of pad backing 78 underneath the edge of wafer 70. This will cause additional material to be removed from the center of wafer 70 thereby improving the uniformity of the polished wafer.

It will be appreciated to those skilled in the art having the benefit of this disclosure that this invention is believed to provide an apparatus and method for polishing semiconductor substrates. Further modifications and alternative embodiments of various aspects of the invention will be apparent to those skilled in the art in view of this description. For example, other gases such as argon could be used in place of air as the working fluid in the fluid-bearing platen. It is intended that the following claims are interpreted to embrace all such modifications and changes and, accordingly, the specification and drawings are to be regarded in an illustrative rather than a restrictive sense.

What is claimed is:

1. An apparatus for polishing of a semiconductor substrate, comprising:

a carrier adapted to secure the semiconductor substrate upon a polishing pad;

a fluid-bearing platen spaced below the polishing pad and aligned beneath the carrier for driving fluid against the polishing pad during use;

a pad backing affixed to the polishing pad; and a holder for securing an outer periphery of the pad backing such that the pad backing is spaced above the fluid-bearing platen.

2. The apparatus of claim 1, wherein the platen comprises a plurality of conduits through which the fluid is adapted to be selectively driven against the polishing pad with sufficient force to counter a force of the semiconductor substrate upon the polishing pad.

3. The apparatus of claim 2, wherein the fluid is driven through a set of the plurality of conduits with greater force than the fluid is driven through another set of the plurality of conduits.

4. The apparatus of claim 1, further comprising a polish-delivery conduit placed above the polishing pad for delivery of a polish fluid to an upper surface of the polishing pad, between the polishing pad and the semiconductor substrate.

5. An apparatus for polishing of a semiconductor substrate, comprising:

a pad backing;

a polishing pad affixed to a planar surface of the pad backing;

a holder upon which the pad backing is adapted for attachment only at its outer edge;

a carrier adapted to secure the semiconductor substrate upon an upper surface of the polishing pad;

a fluid-bearing platen arranged a spaced distance from the pad backing directly beneath the carrier-secured semiconductor substrate; and a polish-delivery conduit arranged above the polishing pad for delivery of a polishing fluid to an upper surface of the polishing pad.

6. The apparatus of claim 5, wherein the pad backing comprises a taut, thin metal membrane.

7. The apparatus of claim 6, wherein both the polishing pad and the pad backing having a circular, planar surface.

8. The apparatus of claim 5, wherein the polishing pad, the pad backing, and the holder rotate about their common center.

9. The apparatus of claim 5, wherein the carrier and the semiconductor substrate rotate about their common center.

10. The apparatus of claim 5, wherein the fluid-bearing platen does not make mechanical contact with the pad backing.

11. The apparatus of claim 5, wherein the fluid-bearing platen comprises a flow of a fluid which supports the pad backing and polishing pad against the semiconductor substrate.

12. The apparatus of claim 11, wherein the fluid-bearing platen comprises multiple zones of different fluid flow rates.

13. The apparatus of claim 11, wherein the fluid comprises air.

14. The apparatus of claim 5, further comprising at least one more additional carrier, wherein each additional carrier is adapted to secure an additional semiconductor substrate upon the upper surface of the polishing pad.

15. The apparatus of claim 14, wherein each additional carrier and semiconductor substrate pair rotate about their common center.

16. The apparatus of claim 14, wherein an additional fluid-bearing platen for each additional semiconductor substrate is arranged below the lower surface of the pad backing and located directly underneath the additional semiconductor substrate.

17. The apparatus of claim 1, wherein the fluid comprises air.

18. The apparatus of claim 1, wherein the polishing pad, the pad backing, and the holder are operated to be rotated about their common center during use.

19. The apparatus of claim 5, wherein the spaced distance comprises air.

20. The apparatus of claim 5, wherein the fluid-bearing platen is adapted for motion with respect to the pad backing.

21. The apparatus of claim 5, further comprising at least one more additional platen, wherein each additional platen is paired with an additional carrier, and wherein the pad backing is large enough to accommodate the platen/carrier pairs.

* * * * *